US005999763A

United States Patent [19]

Hiroshima et al.

[11] Patent Number: 5,999,763

[45] Date of Patent: Dec. 7, 1999

[54] SIMULTANEOUS CLEANING OF RESIDUAL TONER AND TONER IMAGE FORMATION

[75] Inventors: Koichi Hiroshima, Shizuoka-ken; Katsuhiko Nishimura, Yokohama, both of Japan

[73] Assignee: Canon Kabushiki Kaisha, Tokyo, Japan

[21] Appl. No.: 09/082,917

[22] Filed: May 21, 1998

[30] Foreign Application Priority Data

May 23, 1997 [JP] Japan ..... 9-134091
May 11, 1998 [JP] Japan ..... 10-127377

[51] Int. Cl.[6] ..... G03G 15/00; G03G 15/16

[52] U.S. Cl. ..... 399/66; 399/297; 399/298; 399/302

[58] Field of Search ..... 399/66, 101, 297, 399/298, 300, 302, 308

[56] References Cited

U.S. PATENT DOCUMENTS

| | | | |
|---|---|---|---|
| 5,600,431 | 2/1997 | Takeda et al. | 399/226 |
| 5,732,310 | 3/1998 | Hiroshima et al. | 399/101 |
| 5,752,130 | 5/1998 | Tanaka et al. | 399/101 |
| 5,809,373 | 9/1998 | Yoda et al. | 399/101 |

*Primary Examiner*—William J. Royer

*Attorney, Agent, or Firm*—Fitzpatrick, Cella, Harper & Scinto

[57] ABSTRACT

The present invention provides an image forming apparatus which includes a movable image bearing member for bearing a toner image, a movable intermediate transfer member to which the toner image on the image bearing member is electrostatically transferred at a first transfer position, and a charger for charging residual toner remaining on the intermediate transfer member after the toner image on the intermediate transfer member has been electrostatically transferred onto a transfer material at a second transfer position with polarity opposite to charging polarity of the normal toner on the image bearing member. An electric field is formed so that the residual toner charged by the charger from the intermediate transfer member onto the image bearing member and a transfer of a next toner image from the image bearing member onto the intermediate transfer member are simultaneously performed at the first transfer position. Also included is a controller for controlling so that a relative position of a first toner image transferred to a first transfer material from the intermediate transfer member with respect to the intermediate transfer member and a relative position of a second toner image transferred to a second transfer material from the intermediate transfer member with respect to the intermediate transfer member are differentiated.

14 Claims, 6 Drawing Sheets

SIMULTANEOUS CLEANING OF RESIDUAL TONER AND TONER IMAGE FORMATION

BACKGROUND OF THE INVENTION

1. Field of the Invention

The present invention relates to an image forming apparatus in which toner images formed on an image bearing member are successively transferred onto an intermediate transfer member, and then the toner images on the intermediate transfer member are transferred onto a transfer material collectively.

2. Related Background Art

There has been proposed an image forming apparatus in which toner images formed on a drum-shaped electrophotographic photosensitive member (referred to as "photosensitive member" hereinafter) as an image bearing member are firstly-transferred onto an intermediate transfer member and then the toner images on the intermediate transfer member are secondary-transferred onto a transfer material collectively, thereby forming an image. Such an image forming apparatus is useful as a color image forming apparatus or a multi-color image forming apparatus in which a plurality of color component images corresponding to color image information or multi-color image information are successively transferred in a superimposed fashion to reproduce a color image or a multi-color image as an imaged print. According to such an image forming apparatus, an image having less deviation in superimposed color components can be obtained.

In the image forming apparatus having the intermediate transfer member, after the toner images are secondary-transferred from the intermediate transfer member to the transfer material such as a paper sheet, there remains residual toner on the intermediate transfer member. Removal of such residual toner is a technical problem which arises during operation of the apparatus. In order to solve such a technical problem, there has been proposed a so-called "first-transferring and simultaneous cleaning" technique in which a charge roller (as toner charging means) is urged against the intermediate transfer member. And, during next firstly-transferring, by applying, to the charge roller, a bias voltage for charging the residual toner to a polarity opposite to the potential on the photosensitive member, the residual toner on the intermediate transfer member is returned to the photosensitive member at the same time when the next toner image is transferred from the photosensitive member onto the intermediate transfer member.

In the conventional image forming apparatus having the intermediate transfer member, the first-transferring and simultaneous cleaning is achieved by simultaneously replacing toners having opposite polarity with each other at a firstly-transfer nip between the photosensitive member and the intermediate transfer member. In the secondary-transferring for transferring the toner images from the intermediate transfer member to the transfer material, although almost all of the toner is transferred to the transfer material, a very little amount of toner remains on the intermediate transfer member as residual toner. Thus, when same images are formed (printed) continuously, since the toner images are successively formed on the same area of the intermediate transfer member, the residual toner on the intermediate transfer member trying to return to the photosensitive member is blocked by the toner being transferred from the photosensitive member to the intermediate transfer member. As the result, the residual toner charged with opposite polarity is gradually accumulated on the intermediate transfer member.

Consequently, when a different image is transferred after the same images were transferred continuously, the accumulated residual toner is transferred onto the photosensitive member while absorbing the toner to be transferred to the intermediate transfer member, thereby generating a ghost image (negative ghost) in the next print image. This is true particularly when mono-color (for example, black) images are printed continuously.

SUMMARY OF THE INVENTION

An object of the present invention is to provide an image forming apparatus in which poor transferring of residual toner from an intermediate transfer member to an image bearing member can be prevented and poor transferring of a toner image from the image bearing member to the intermediate transfer member can also be prevented.

DETAILED DESCRIPTION OF THE PREFERRED EMBODIMENTS

The present invention will now be fully explained in connection with embodiments thereof with reference to the accompanying drawings.

[First Embodiment]

Figure 1:
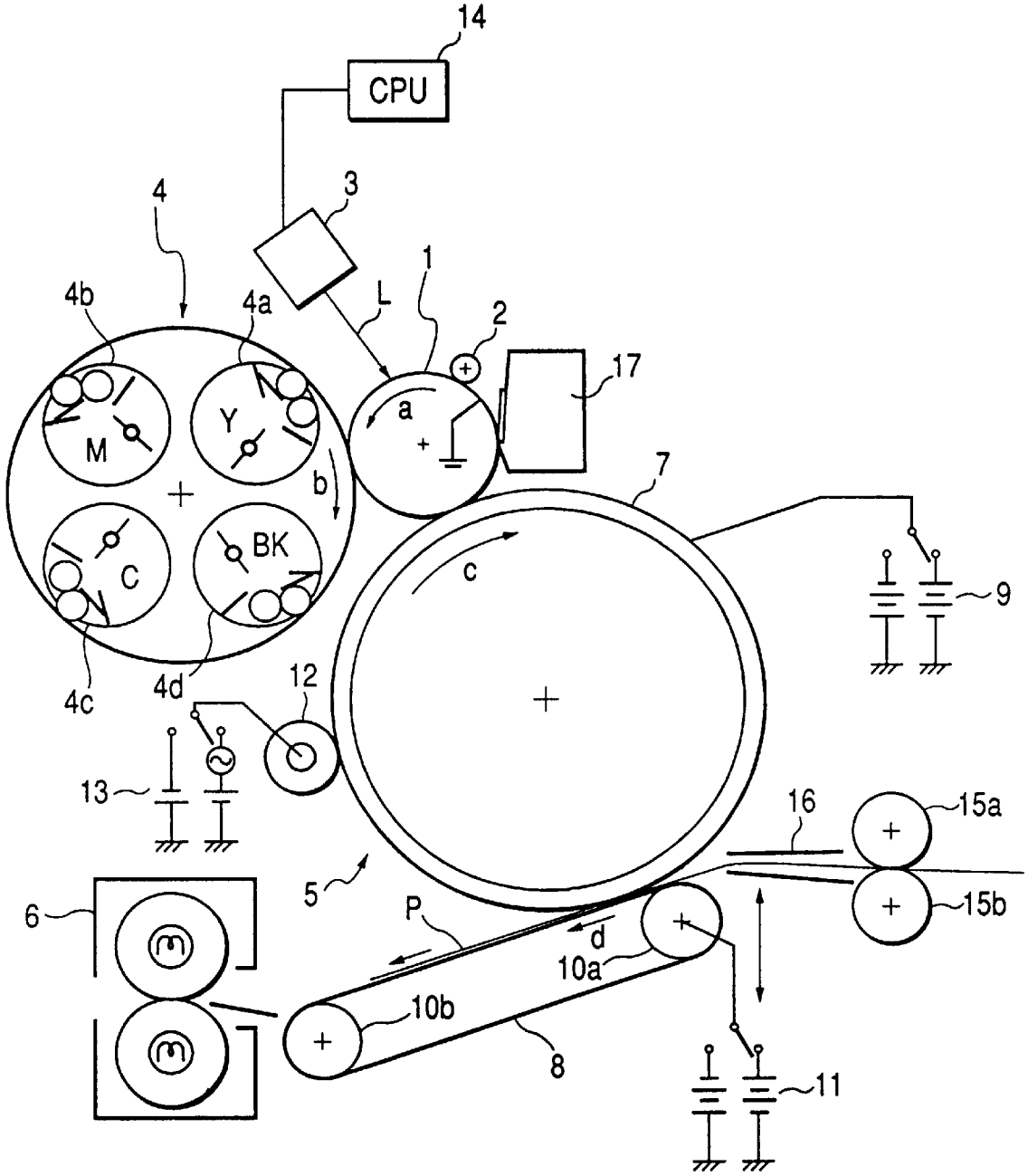
FIG. 1 is a schematic constructural view showing an image forming apparatus according to a first embodiment of the present invention.

FIG. 1 is a schematic constructural view showing an image forming apparatus (a laser beam printer capable of forming a color image) according to a first embodiment of the present invention.

The image forming apparatus comprises a photosensitive member (image bearing member) 1, a charge roller 2, an exposure device 3, a developing means 4, a transfer device 5, and a fixing device 6.

In the illustrated embodiment, the photosensitive member 1 is an organic photosensitive body which can be charged negatively and is constituted by coating a photoconductive layer on an aluminium drum base (not shown). The photosensitive member is rotated at a predetermined process speed in a direction shown by the arrow a. The charge roller 2 is urged against the photosensitive member 1 with predetermined pressure and is rotatingly driven by rotation of the photosensitive member 1. The photosensitive member 1 is charged with predetermined polarity and potential by applying a predetermined bias voltage (for example, voltage obtained by overlapping AC voltage with DC voltage) to the charge roller 2.

The developing means 4 includes a Y (yellow) developing device 4*a*, an M (magenta) developing device 4*b*, a C (cyan) developing device 4*c* and a BK (black) developing device 4*d* and is rotated by a rotation driving device (not shown) in a direction shown by the arrow b so that a selected developing device (Y developing device 4*a*, M developing device 4*b*, C developing device 4*c* or BK developing device 4*d*) is opposed to the photosensitive member 1 during development.

The transfer device 5, includes a cylindrical intermediate transfer member 7 having a multi-layer structure for effecting firstly-transferring, and a transfer belt 8 for effecting secondary-transferring. The intermediate transfer member 7 is urged against the surface of the photosensitive member 1 and the surface of the transfer belt 8 and is rotatingly driven at the same peripheral speed as that of the photosensitive member 1 in a direction shown by the arrow c. A firstly-transfer bias power source 9 is connected to the intermediate transfer member 7 to apply a predetermined firstly-transfer bias (DC voltage) to the intermediate transfer member 7.

The transfer belt 8 is an endless belt mounted around a transfer roller (bias roller) 10*a* and a tension roller 10*b* in a tension condition and is rotated by rotation of the transfer roller 10*a* so that an upper run of the belt is moved in a direction shown by the arrow d. The transfer belt 8 can be engaged by and disengaged from the intermediate transfer member 7 by means of a drive means (not shown). A secondary-transfer bias power source 11 is connected to the transfer roller 10*a* to apply a predetermined secondary-transfer bias (DC voltage) to the transfer roller 10*a*. The same bias voltage as that of the transfer roller 10*a* is applied to the tension roller 10*b*.

An intermediate transfer member cleaning roller 12 having a multi-layer structure can be engaged by and disengaged from the intermediate transfer member 7, and a predetermined bias voltage is applied from a cleaning bias power source 13 to the intermediate transfer member cleaning roller 12. The exposure device (laser scanner) 3 is connected to a control device (CPU) 14 (fully described later) for controlling so that image exposure (laser beam) L corresponding to image information incident on the photosensitive member 1 is deviated (changed) for every image.

Next, an image forming operation of the image forming apparatus will be explained.

During image formation, the surface of the photosensitive member 1 is rotated by a drive means (not shown) at a predetermined process speed in the direction a and is uniformly charged with a predetermined polarity and potential by the charge roller 2 to which the predetermined charge bias (voltage obtained by overlapping AC voltage with DC voltage) was applied. The image exposure (laser beam) L is applied from the exposure device 3 to the charged photosensitive member 1, thereby forming an electrostatic latent image corresponding to a first color component image (for example, yellow color component image) of a target color image. Then, the electrostatic latent image is developed by the Y (yellow) developing device 4*a* with yellow toner (first color).

While the yellow toner image formed on the photosensitive member 1 is passing through a firstly-transfer nip (first transfer station) between the photosensitive member 1 and the intermediate transfer member 7, the yellow toner image is firstly-transferred onto the peripheral surface of the intermediate transfer member 7 by pressure at the firstly-transfer nip and an electric field generated by the firstly-transfer bias applied from the firstly-transfer bias power source 9 to the intermediate transfer member 7. Similarly, a magenta toner image, a cyan toner image and a black toner image are formed on the photosensitive member 1 by the M (magenta) developing device 4*b*, C (cyan) developing device 4*c* and BK (black) developing device 4*d*, respectively, and are successively transferred onto the intermediate transfer member 7 in a superimposed fashion, thereby forming a synthetic color toner image corresponding to the target color image. This process is referred to as "firstly-transferring".

In this case, the firstly-transfer bias applied from the firstly-transfer bias power source 9 to successively transfer the color images from the photosensitive member 1 to the intermediate transfer member 7 in the superimposed fashion has (positive) polarity opposite to that of the toner. Incidentally, in the successive superimposed transferring of the color images from the photosensitive member 1 to the intermediate transfer member 7, the transfer belt 8 and the intermediate transfer member cleaning roller 12 are spaced apart from the intermediate transfer member 7.

A transfer material P such as a paper sheet is supplied from a sheet supply cassette (not shown) to a second transfer nip (second transfer station) (in the vicinity of the transfer roller 10*a*) through regist rollers 15*a*, 15*b* and a pre-transfer guide 16. In this case, the secondary-transfer bias (DC voltage) is applied from the secondary-transfer bias power source 11 to the transfer roller 10*a*, thereby transferring the synthetic color toner image from the intermediate transfer member 7 to the transfer material P. This process is referred to as "secondary-transferring".

The transfer material P to which the synthetic color toner image was transferred is conveyed, by the transfer belt 8, to the fixing device 6, where the synthetic color toner image is fixed to the transfer material P with heat and pressure.

Secondary-transferring residual toner (residual toner) remaining on the intermediate transfer member 7 is electrostatically absorbed by the photosensitive member 1 by changing the polarity of the residual toner to a positive polarity opposite to the initial polarity (the normal negative charging polarity of the toner on the photosensitive member) by the intermediate transfer member cleaning roller 12 to which the predetermined charge bias (voltage obtained by overlapping AC voltage with DC voltage, in the illustrated embodiment) was applied from the cleaning bias power source 13. In this way, the intermediate transfer member 7 is cleaned. Thereafter, the secondary-transferring residual toner absorbed to the photosensitive member 1 is collected by a cleaning device 17.

By applying the predetermined bias (having positive polarity) from the firstly-transfer bias power source 9 to the intermediate transfer member 7, at the same time when the toner is firstly-transferred from the photosensitive member 1 to the intermediate transfer member 7, the secondary-transferring residual toner on the intermediate transfer member 7 can be returned to the photosensitive member 1. When images are formed on a plurality of transfer materials continuously by effecting the first-transferring and simultaneous cleaning in this way, through-put for image formation can be improved.

Now, a mechanism for returning the secondary-transferring residual toner will be explained. When the toner is transferred onto the transfer material P from the intermediate transfer member 7 by the transfer belt 8, almost all of secondary-transferring residual toner is remaining on the intermediate transfer member 7 in a condition that it is charged with (positively) polarity opposite to the normal charging polarity (negative polarity in the illustrated embodiment) of the toner. However, all of the toner is not reversed to the positive polarity, but, there are neutralized toner having no charge and toner still having negative polarity. Since these toners can be reversed to the opposite polarity by the intermediate transfer member cleaning roller 12, all of the secondary-transferring residual toner can be returned to the photosensitive member 1.

At the firstly-transfer nip between the photosensitive member 1 and the intermediate transfer member 7, the toner reversely charged on the intermediate transfer member 7 is transferred onto the photosensitive member 1 and the normally charged toner to be firstly-transferred is transferred onto the intermediate transfer member 7. The reason is that, by weakening the electric field acting between the photosensitive member 1 and the intermediate transfer member 7 at the firstly-transfer nip by reducing the firstly-transfer bias and by suppressing the charging of the toner by discharge at the firstly-transfer nip, the positively charged toner and the negatively charged toner can move independently.

Next, the intermediate transfer member cleaning roller 12 will be fully described.

Figure 2:
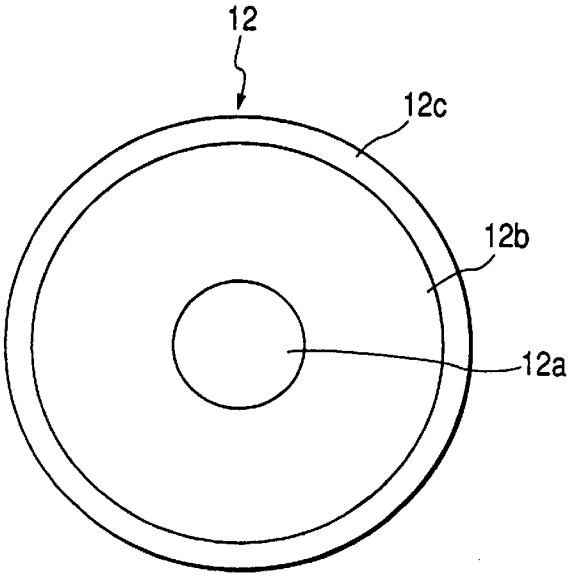
FIG. 2 is a sectional view showing an intermediate transfer member cleaning roller of the image forming apparatus.

As shown in FIG. 2, the intermediate transfer member cleaning roller 12 is constituted by a cylindrical core 12*a*, a cylindrical elastic layer 12*b* coated on the cylindrical core, and a coating layer 12*c* provided on the elastic layer. The cylindrical core 12*a* is formed from metal such as stainless steel, and the elastic layer 12*b* is formed from rubber or sponge having volume resistivity of $10^6$ to $10^{11}$ Ωcm (when 1 KV is applied). Similar to the charge roller 2 for charging the photosensitive member 1, the material of the coating layer 12*c* is an important factor for achieving the cleaning of the intermediate transfer member cleaning roller 12. Thus, to obtain resistance control and suppress microscopic resistance unevenness, the intermediate transfer member cleaning roller 12 is formed as a two-layer structure in which the resistance value is roughly controlled by the elastic layer 12*b* and the resistance value is finely adjusted by the coating layer 12*c*.

The coating layer 12*c* must have the surface resistance value sufficient to generate the discharge when it is contacted with the intermediate transfer member 7, and, thus, the surface resistance value of $10^6$ to $10^{11}$ Ω/□ (when 1 KV is applied) is effective. The surface resistance was measured as follows. A sample was made by coating a coating layer (same as the above-mentioned coating layer) on a conductive sheet having dimension of 100 mm×100 mm, and the resistance of the sheet was measured by using R8340 and R12704 manufactured by Advantest Inc. under the condition of applied voltage of 1 KV, discharge 5 sec, charge of 30 sec and measured of 30 sec.

In the illustrated embodiment, the intermediate transfer member cleaning roller 12 has an outer diameter of about 18 mm and is constituted by mounting the elastic layer 12*b* made of urethane sponge having a thickness of 3 mm and volume resistivity of $10^7$ Ωcm (when 1 KV is applied) around the cylindrical core 12*a* having an outer diameter of 12 mm and made of stainless steel and coating the coating layer 12*c* having a thickness of 200 μm and surface resistance value of $10^{14}$ Ω/□ (when 1 KV is applied) on the elastic layer.

Figure 3:
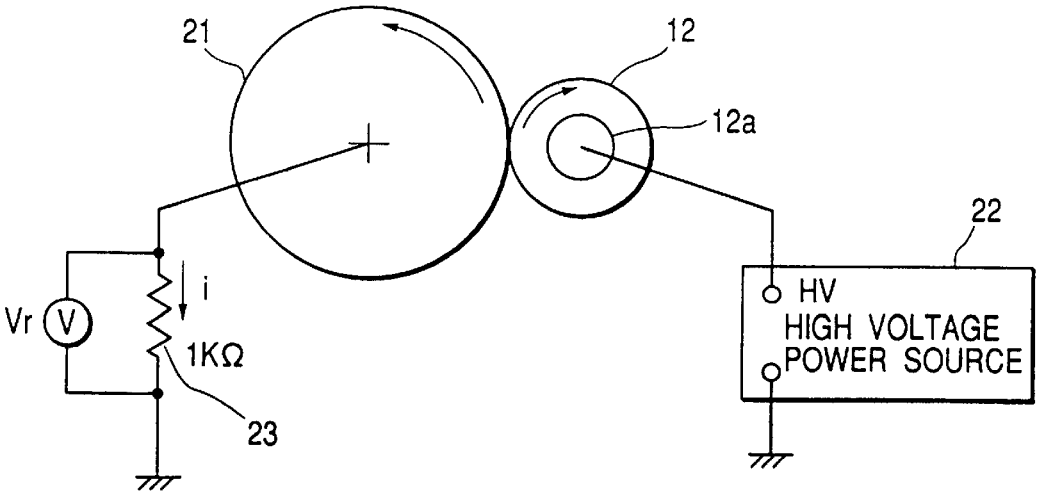
FIG. 3 is a schematic view showing a measuring device for measuring resistance of the intermediate transfer member cleaning roller.

The actual resistance value of the intermediate transfer member cleaning roller 12 is measured by a measuring device shown in FIG. 3. The measuring device has an aluminium cylinder 21 contacted with the intermediate transfer member cleaning roller 12, a high voltage power source 22, and a standard resistance 23. The actual resistance value used herein means resistance of the entire intermediate transfer member cleaning roller 12 including the elastic layer 12*b* and the coating layer 12*c*.

When the resistance value of the intermediate transfer member cleaning roller 12 is measured, the aluminium cylinder 21 is rotated by a drive means (not shown) and the intermediate transfer member cleaning roller 12 (contacted with the aluminium cylinder) is rotatingly driven by rotation of the aluminium cylinder. In this case, the contact pressure is selected to about 1 kgf (similar to that used in the actual image formation). By applying an AC constant voltage from the high voltage power source 22 to the core 12*a* of the intermediate transfer member cleaning roller 12, current passing through the elastic layer 12*b* and the coating layer 12*c* flows into the aluminium cylinder 21 and is grounded through the standard resistance 23 (1 KV).

When the voltage between both ends of the standard resistance 23 is Vr (V), the resistance value Rc of the intermediate transfer member cleaning roller 12 is given by the following equation:

$$Rc\ (\Omega)=10^6/Vr\ (V)$$

It was found that the actual resistance value of the intermediate transfer member cleaning roller 12 obtained from the above equation is $2\times10^9$ Ω. Further, it was ascertained that the range of the actual resistance value effective to the intermediate transfer member is $5\times10^6$ to $5\times10^9$ Ω (measured by the above-mentioned measuring method) and the thickness of the coating layer 12*c* of 100 to 300 μm is effective.

Next, the intermediate transfer member 7 will be fully described.

Figure 4:
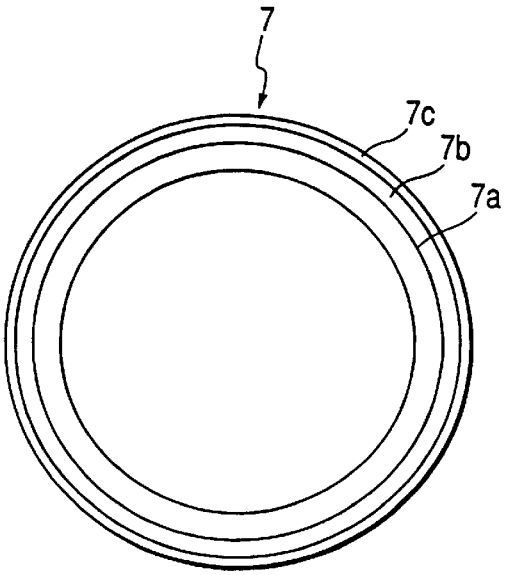
FIG. 4 is a sectional view showing an intermediate transfer member of the image forming apparatus.

As shown in FIG. 4, the intermediate transfer member 7 is a seamless member and is constituted by mounting a cylindrical elastic layer 7*b* around a cylindrical conductive support member 7*a* and coating a coating layer 7*c* on the elastic layer. The support member 7*a* is formed from metal such as aluminium having a thickness of 3 mm, and, regarding the elastic layer 7*b*, in order to attach importance to only the resistance value, ketchen black as a conductive agent is dispersed into acrylonitrile-butadiene rubber (NBR) to control the volume resistivity. It is desirable that the thickness of the elastic layer 7*b* is selected to about 0.5 to 7 mm in consideration of formation of the transfer nip, color deviation caused by rotation and cost of material. In the illustrated embodiment, the thickness is selected to 5 mm.

It is desirable that the thickness of the coating layer 7*c* is selected to 5 to 5 μm to transmit the softness of the underlying elastic layer 7*b* to the surface of the photosensitive member 1. In the illustrated embodiment, the thickness is selected to 15 μm. In the illustrated embodiment, an outer diameter of the intermediate transfer member 7 is selected to 180 mm. The coating layer 7*c* of the intermediate transfer member 7 is important since it affects a great influence upon the cleaning ability for removing the secondary-transferring residual toner. The coating layer 7*c* is obtained by dispersing aluminium borate wisker (as conductive agent for resistance control) and PTFE powder (for improving toner mold releasing ability) into urethan resin (binder).

The volume resistivity of the elastic layer 7*b* was measured as follows. A sheet having dimension of 100 mm×100 mm was obtained from the above elastic layer 7*b* having a predetermined thickness, and the volume resistivity of the sheet was measured by using R8340 and R12704 manufactured by Advantest Inc. under the condition of applied voltage of 1 KV, discharge of 5 sec, charge of 30 sec and measure of 30 sec.

Next, the transfer belt 8 will be fully described.

The transfer roller (bias roller) 10*a* and the tension roller 10*b* which support the transfer belt 8 may be formed from the same material or different materials. In the illustrated embodiment, the rollers are formed from EPDM having an outer diameter of 20 mm, hardness of 60 degrees (JIS A hardness) and volume resistivity of $5\times10^4$ Ωcm (when 100 V is applied). The transfer belt 8 has a dual layer structure having a thickness of 0.3 mm and including a surface layer made of fluororesin and a base layer made of urethane elastomer, and the volume resistivity is controlled to $10^{11}$ Ωcm and the surface resistance is controlled to $10^{12}$ to $10^{13}$ Ω/□.

When the secondary-transferring residual toner was removed by the intermediate transfer member cleaning roller 12 in the above-mentioned image forming apparatus, the generation of the negative ghost was evaluated. The evaluation was performed as follows.

[Evaluating Method]

After black toner mono-color images having same patterns were printed on the transfer material continuously, a single all black image is printed on a transfer material. And, it was ascertained that the ghost image (negative ghost) appeared in the printed image when how many numbers of the same pattern images were printed.

In this case, the image forming condition of the image forming apparatus shown in FIG. 1 is as follows:

| | |
|---|---|
| Photosensitive member 1: | OPC photosensitive drum |
| Surface potential: | dark potential (potential of non-image portion due to first charging) Vd = −550 V<br>bright potential (potential of image portion due to image exposure) Vl = −150 V |
| Developing method: | |
| YMC toners: | non-magnetic one-component jumping development |
| developing bias: | Vdc = −400 V<br>Vac = 1800 Vpp<br>frequency = 2300 Hz |
| Bk toner: | magnetic one-component jumping development |
| developing bias: | Vdc = −400 V<br>Vmax (fixed) = −1400 V<br>Duty = 55:45<br>frequency = 2300 Hz |
| Firstly-transferring bias: | 100 V |
| Process speed: | 120 mm/sec |
| Urging pressure of intermediate transfer member 7 against photosensitive member: | 2 kgf |
| Urging pressure of transfer belt 8 against intermediate transfer member 7: | 5 kgf |
| Urging pressure of intermediate transfer member cleaning roller 12 against intermediate transfer member 7: | 1 kgf |

Figure 5:
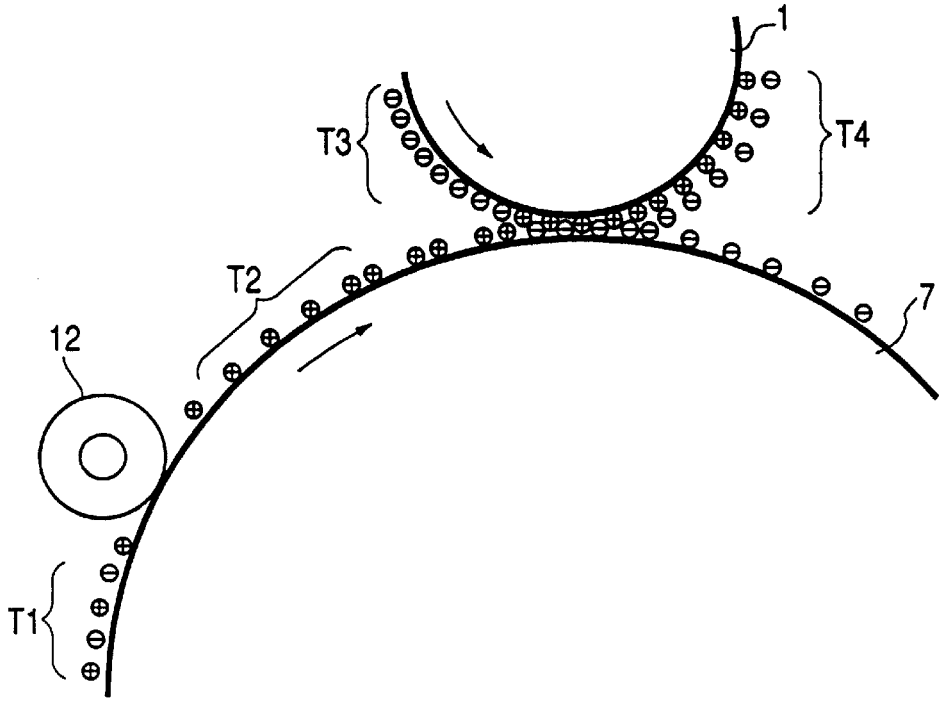
FIG. 5 is a view for explaining a mechanism for generating negative ghost on the intermediate transfer member.

Next, a mechanism for generating the negative ghost at the intermediate transfer member 7 during the image formation will be explained with reference to FIG. 5.

Toner T1 remaining on the intermediate transfer member 7 after the secondary-transferring process is secondary-transferring residual toner which was not secondary-transferred, which toner includes toner charged positively, toner charged negatively and toner having no charge. By applying a (AC+DC) bias to the intermediate transfer member cleaning roller 12, all of the residual toners are charged with polarity (positive polarity) opposite to the normal toner polarity.

As a result, almost all toner T2 passed through the intermediate transfer member cleaning roller 12 has been charged with positive polarity. When the positively charged toner T2 is passed through the firstly-transfer nip of the photosensitive member 1, it is replaced by the toner T3 having normal polarity (negative polarity) being firstly-transferred from the photosensitive member 1. That is to say, the reversely charged toner T2 on the intermediate transfer member 7 is transferred onto the photosensitive member 1, and the normally charged toner on the photosensitive member 1 is transferred onto the intermediate transfer member 7. Since the potential on the intermediate transfer member 7 is +100 V and the potential on the photosensitive member 1 is −550 V (dark portion potential) and −150 V (bright portion potential), the toners T1, T2, T3 perform as mentioned above under the action of the electric field.

If the toner tribo of the reversely charged toner T2 on the intermediate transfer member 7 becomes too great, the firstly-transferred toner T3 is absorbed by toner T4 being transferred onto the photosensitive member 1. As a result, the toner transferred to the intermediate transfer member 7 becomes partially void (Since the void pattern is the same as the previous image pattern, this is referred to as "negative ghost"). By properly controlling the bias applied to the intermediate transfer member cleaning roller 12 to prevent the toner tribo of the reversely charged toner T2 on the intermediate transfer member 7 from becoming too great, the generation of the negative ghost is prevented.

Figure 6:
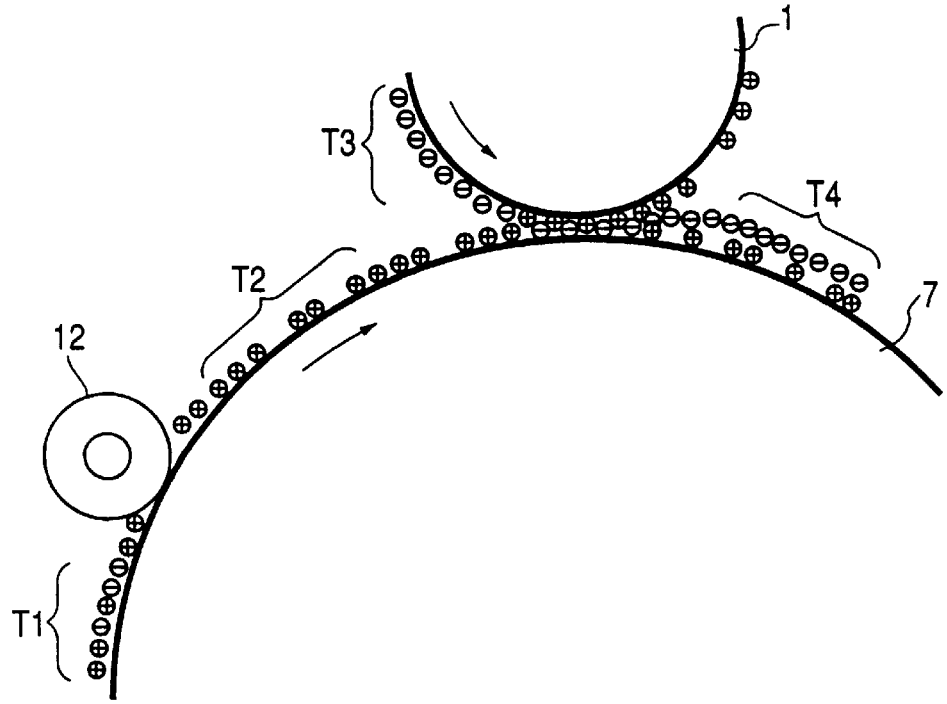
FIG. 6 is a view showing a condition that toner is accumulated on the intermediate transfer member.

However, if the same patterns are transferred to the same position on the intermediate transfer member 7 in a superimposed fashion, the toner trying to return from the intermediate transfer member 7 to the photosensitive member 1 is blocked by the toner to be firstly-transferred from the photosensitive member 1 to the intermediate transfer member 7, with the result that, as shown in FIG. 6, the toner cannot be transferred to the photosensitive member 1 and is accumulated on the intermediate transfer member 7. Although the toner T2 reversely charged by the intermediate transfer member cleaning roller 12 tries to be transferred to the intermediate transfer member 7 at the firstly-transfer nip of the photosensitive member 1, if an amount of the firstly-transferred toner is great (more specifically, if an amount of toner per unit area (M/A (mg/cm$^2$) is great), the toner cannot overcome the electric field of the toner to be firstly-transferred, with the result that the toner remains on the intermediate transfer member 7.

The inventors found that the reason why the M/A becomes great is that the sweeping of toner is generated by the edge effect in the developing process. The sweeping becomes great in the fine lines of the line image rather than the solid pattern.

Figure 7:
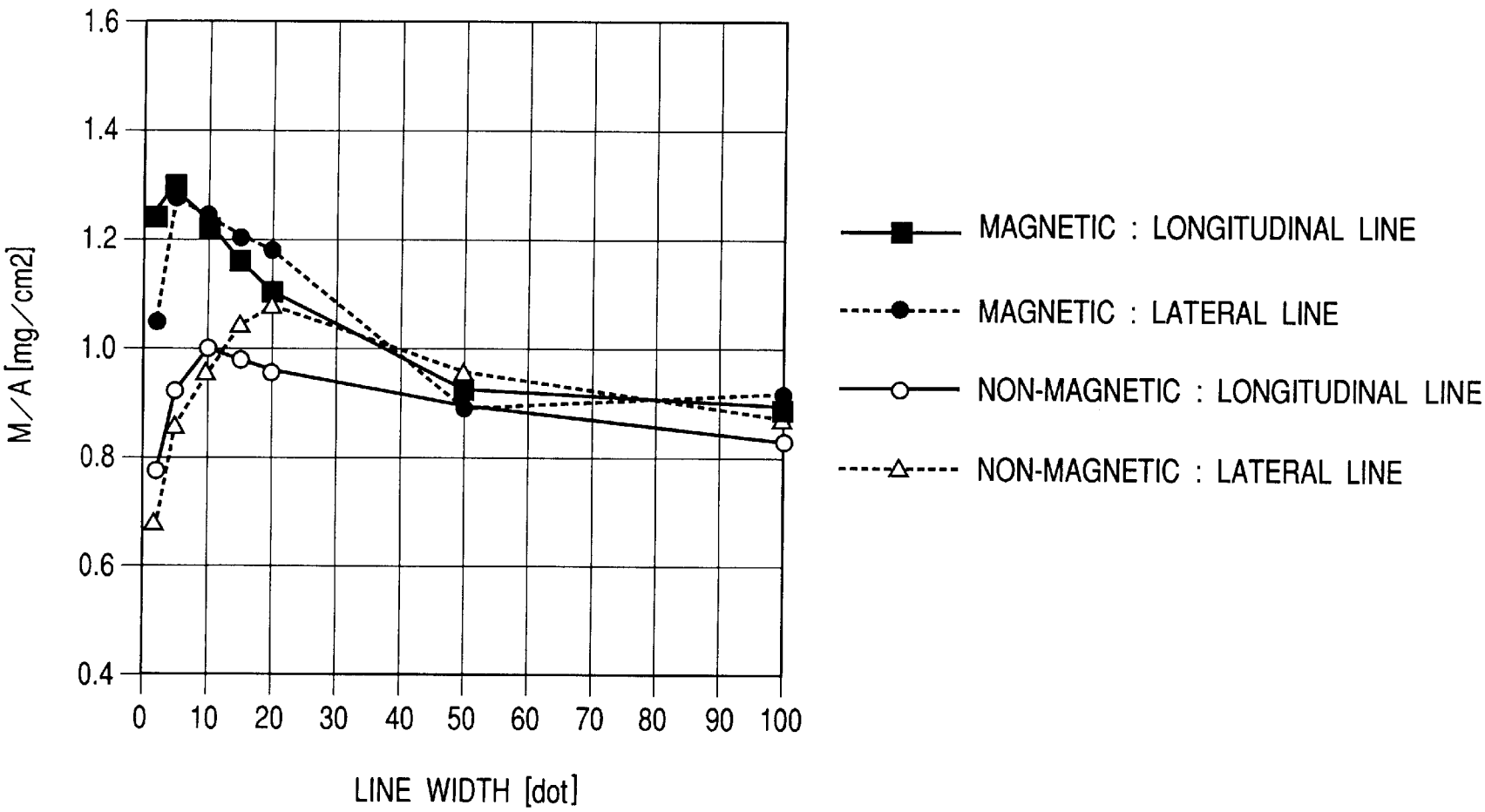
FIG. 7 is a graph showing a relation between a line width and a toner amount (M/A) per unit area.

FIG. 7 is a view showing a relation between the line width and M/A and shows M/A when dots of longitudinal and lateral lines of 600 dpi are changed in the magnetic one-component jumping development and the non-magnetic one-component jumping development. As shown in FIG. 7, although M/A of the toner depends upon the toner and the developing method, in the magnetic one-component jumping development, at the resolving power of 600 dpi, the peak is generated in the vicinity of 5 dot line, and, in the non-magnetic one-component development, the peak is generated in the vicinity of 10 dot line regarding the longitudinal line and in the vicinity of 20 dot line regarding the lateral line. The peak value is greater than M/A of the solid pattern by about 1.4 to 1.5 times in the magnetic one-component jumping development and by about 1.2 to 1.3 times in the non-magnetic one-component development.

Accordingly, the influence of the sweeping of the magnetic toner jumping development is greater than that of the non-magnetic toner jumping development, and, in the illustrated embodiment, since the BK toner is magnetic, the negative ghost is most apt to occur when the black mono-color images are printed continuously. And, in the continuous print of the same pattern, the cleaning condition of the intermediate transfer member 7 is most severe in the case of a character image or a line image formed by about 5 dots.

The cleaning ability of the conventional intermediate transfer member 7 was ascertained by using the above-mentioned evaluating method. The patterns in this case included a set of four longitudinal lines (lines parallel with the shifting direction of the intermediate transfer member) and lateral lines (lines perpendicular to the shifting direction of the intermediate transfer member) of 1 to 100 dots, a half tone pattern and a solid pattern. After three patterns were printed, the pre-print negative ghost was generated in the fourth solid pattern. Particularly, an image in which character lines having fatness of about 5 dot line clearly becomes void was observed.

In consideration of the above, in the first embodiment of the present invention, in order to prevent the generation of the negative ghost, a print controller (not shown) is controlled by a control device (control means) (CPU) 14 so that the signal of the image exposure (laser beam) L illuminated onto the photosensitive member 1 from the exposure device 3 for each image is changed periodically and the writing start position is deviated for each image when the exposure of the photosensitive member 1 is effected. The deviation amount can be set appropriately.

Since the intermediate transfer member 7 is seamless, although the black mono-color images could be formed on the intermediate transfer member 7 successively while gradually deviating the images by a predetermined amount in a sub-scan direction, the pre-print negative ghost was generated in the longitudinal lines of the toner image at an overlapped portion. In such a case, the print controller is controlled by the control device 14 so that the black mono-color image to be formed on the intermediate transfer member 7 is also deviated from the previous toner image by a predetermined amount in a min scan direction by using the exposure device 3.

Next, a case where a vertical synchronous signal outputted to the print controller (not shown) is adjusted by changing it with respect to a writing start position signal (as an absolute reference on the intermediate transfer member 7) in order to escape from the non-image area on the intermediate transfer member 7 on which a toner density control patch is formed will be explained.

Figure 8:
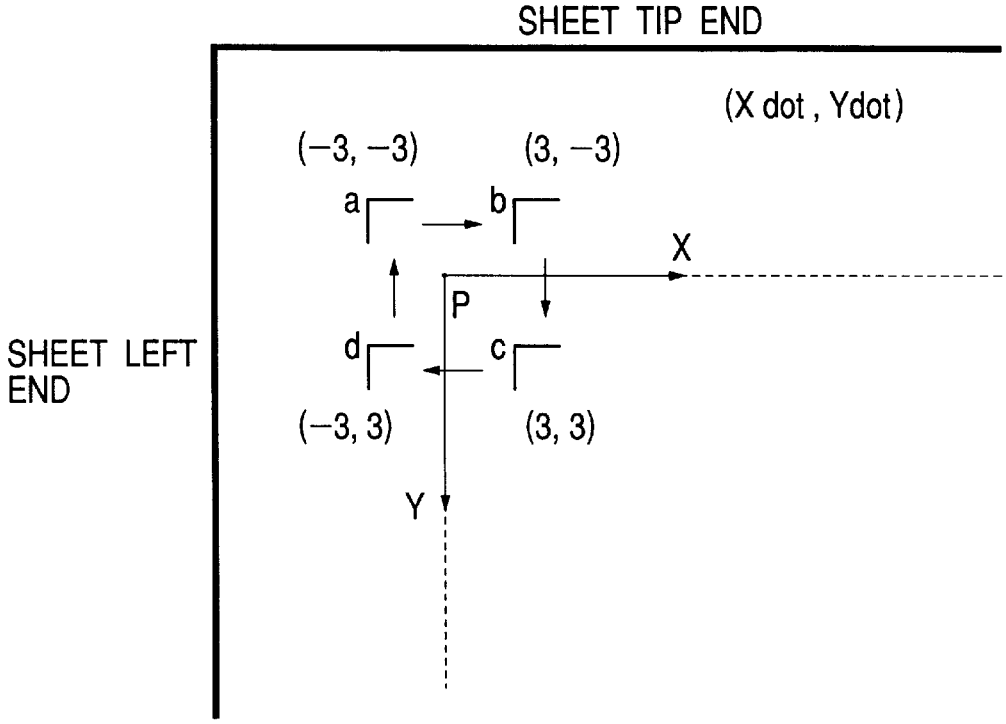
FIG. 8 is a view showing dot shift position in the first embodiment.

FIG. 8 is a view showing a method for deviating or shifting the image writing start position according to the illustrated embodiment. The writing start position for the laser beam has four conditions. That is to say, in the illustrated embodiment, regarding a first sheet, the writing is started from a base point a (−3, −3), and, regarding a second sheet, the writing is started from a point b (3, −3) deviated by 6 dots in the main scan direction of the laser beam. Regarding a third sheet, the writing is started from a point c (3, 3) deviated by 6 dots in the sub-scan direction, and, regarding a fourth sheet, the writing is started from a point d (−3, 3) deviated by 6 dots in the main scan direction of the laser beam, and, regarding a fifth sheet, the writing start position is deviated by 6 dots in the sub-scan direction to return to the first position a (−3, −3).

The reason why the deviation amount or shift amount is selected to 6 dots is that dispersion in tip end registration and left end registration between pages is suppressed by sharing the shift amount to 3 dots in front and rear, respectively and in left and right, respectively, with respect to the absolute writing start position (reference position) of the laser beam inherent to the printer (not shown) and that the vicinity of 5 dots at which M/A of the toner becomes maximum. The shift amount can be set freely within a range permitted by a memory capacity of the print controller (not shown). In the secondary-transferring, the relative position of the transfer material regarding the intermediate transfer member 7 is not shifted.

Since the image forming apparatus according to the illustration has the resolving power of 600 dpi, even when the shift of 6 dots is effected, the registration regarding the sheet end (left end registration) is changed only by about 0.254 mm. This value is included within an allowable error range. In the image forming apparatus according to the illustrated embodiment in which the image writing start position is shifted, when the above-mentioned evaluation was performed, it was ascertained that the negative ghost is not generated in the last solid pattern even after 499 same patterns were printed.

Further, although it was found that the negative ghost is apt to occur when the toner having great M/A is located at the same position over three sheets, in the illustrated embodiment, since only two line patterns having great M/A are located on the intermediate transfer member 7 continuously, the generation of the negative ghost is suppressed. Not only in the black mono-color continuous print, but also in the full-color continuous print, the generation of the negative ghost can be suppressed similarly. In this case, it is controlled so that the same color images between the preceding page and the succeeding page are relatively deviated (in the main scan direction or the sub-scan direction).

In this way, in the illustrated embodiment, since the signal of the image exposure (laser beam) L illuminated on the photosensitive member 1 from the exposure device 3 for each image is changed periodically and the writing start position is shifted for each image when the exposure of the photosensitive member 1 is effected, the deviation between pages is not noticeable and the generation of the negative ghost in the print image can be prevented.

[Second Embodiment]

In the first embodiment, while an example that the image writing start position of the laser beam is shifted in the front-and-rear and left-and-right directions to provide the four conditions was explained, in a second embodiment of the present invention, the image writing start position of the laser beam is shifted simultaneously in the main scan direction and the sub-scan direction to provide only two conditions. The other constructions are the same as those in the first embodiment.

Figure 9:
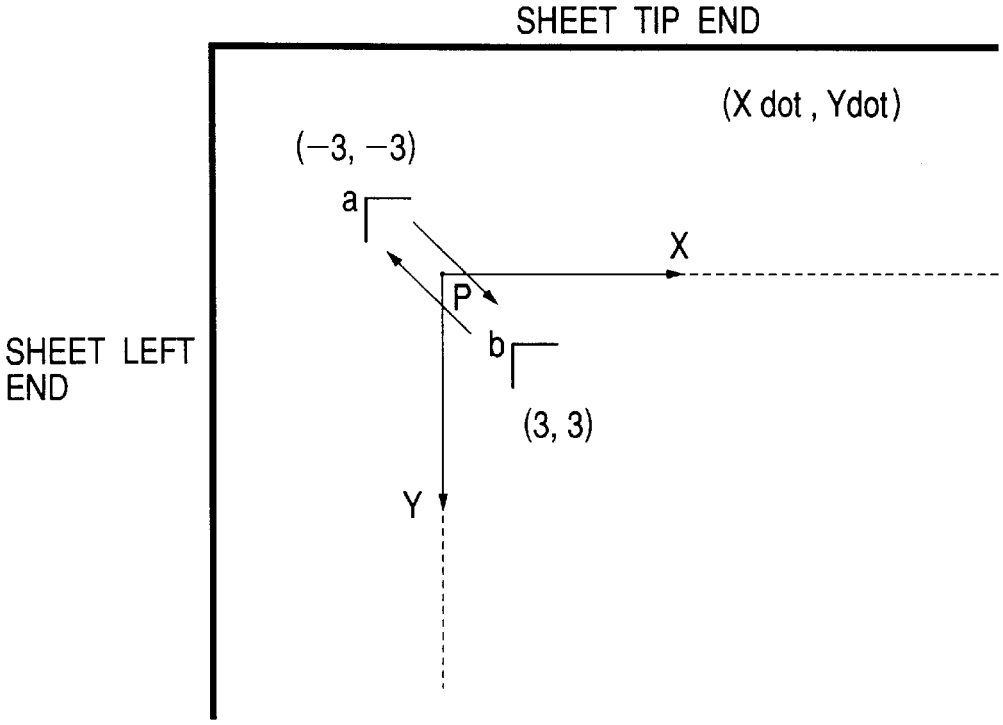
FIG. 9 is a view showing dot shift position in a second embodiment of the present invention.

In the second embodiment, as shown in FIG. 9, regarding a first sheet, the writing is started from a base point a (−3, −3), and, regarding a second sheet, the writing is started from a point b (3, 3) simultaneously deviated by 6 dots in the main scan and sub-scan directions of the laser beam. Regarding a third sheet, the writing start position is deviated simultaneously by 6 dots in the main scan and sub-scan directions of the laser beam to return to the first position a (−3, −3).

Also in the image forming apparatus according to the second embodiment, when the above-mentioned evaluation was performed, it was ascertained that the negative ghost is not generated in the last solid pattern even after 499 same patterns were printed.

In this way, in the second embodiment, by shifting the image writing start position simultaneously in the main scan and sub-scan directions, since the line images having great M/A are not overlapped with each other on the intermediate transfer member 7, the generation of the negative ghost can be suppressed.

Further, when the toner image is shifted in the sub-scan direction for each page by utilizing the advantage of the seamless intermediate transfer member 7 without adjusting the vertical synchronous signal by effecting the change with respect to the writing start position signal (absolute reference on the intermediate transfer member 7), as mentioned above, the generation of the negative ghost can be suppressed by shifting the toner image in the main scan direction for each page.

Further, since only two conditions are provided by simultaneously shifting the writing start position in the main scan and sub-scan direction, the use amount of the memory of the print controller (not shown) can be saved.

[Third Embodiment]

The intermediate transfer member 7 can hold two images on its peripheral surface. Now, the control in this case will be explained. In a third embodiment of the present invention, in synchronous with the fact that the image writing start position on the intermediate transfer member 7 is shifted in the sub-scan direction of the laser beam, the supplying timing of the transfer material P is simultaneously shifted by the same time. The other constructions are the same as those in the first embodiment.

The image formed on the intermediate transfer member 7 is controlled by a writing start position control signal (HP) and the supplying timing is controlled by a supply control signal (RS) outputted at a predetermined interval with respect to the signal HP. Normally, the frequency of the signals HP, RS is the same as one rotation frequency of the intermediate transfer member 7, and, thus, the image writing start position on the intermediate transfer member 7 is fixed.

In the third embodiment, while the time periods of the signals HP, RS are fixed, HP/RS frequency is shifted or deviated from the one rotation frequency of the intermediate transfer member 7 so that the image writing start position on the intermediate transfer member 7 is finely shifted in the main scan and sub-scan direction of the laser beam for each image not to overlap the previously image pattern with the next image pattern on the intermediate transfer member 7.

Figure 10:
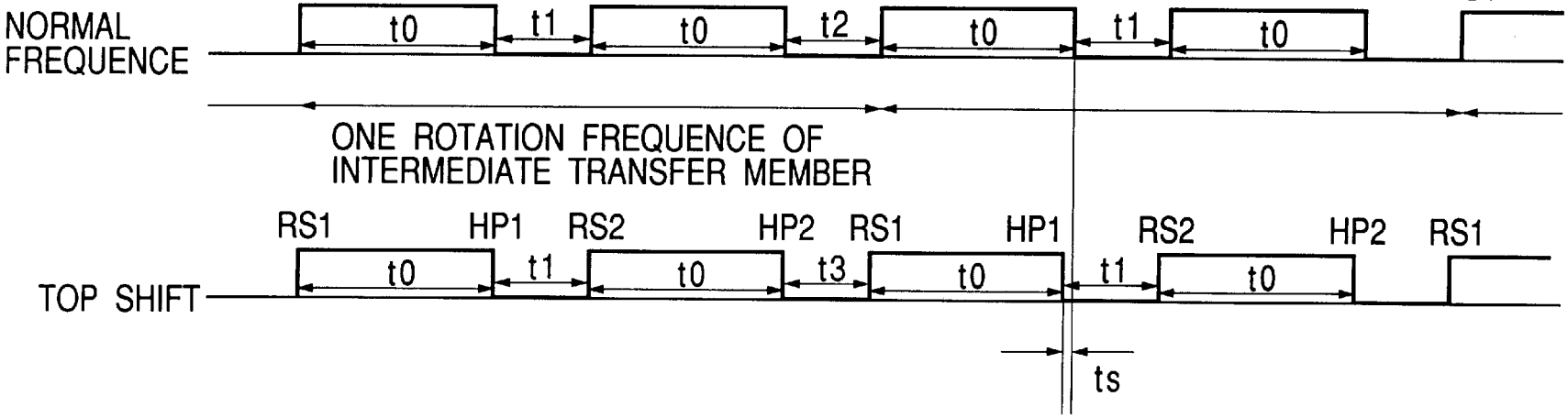
FIG. 10 is a view for explaining dot shift position in a third embodiment of the present invention.

FIG. 10 shows a shifted condition. Since the intermediate transfer member 7 can hold two image having A4/LTR size on its peripheral surface, the image writing start position control signals (HP) and the supply control signals (RS) are provided as RS1/HP1 and RS2/H2. Normally, the one rotation frequency of the intermediate transfer member 7 corresponds to a duration from one RS1 to the next RS1. Further, a time period t0 from RS1 to HP1 and a time period t1 from HP1 to RS2 are determined from the structure of the apparatus, and the time period t1 from HP1 to RS2 corresponding to a sheet-to-sheet distance during two simultaneously print.

In the illustrated embodiment, a time period from HP2 to RS1 is normally t2 and the time period from one RS1 to the next RS1 corresponds to the one rotation frequency of the intermediate transfer member 7, and the control device (CPU) 14 controls so that the time period t2 is shortened by a time period ts to obtain a time period t3 (=t2−ts), thereby becoming the time period from one RS1 to the next RS1 smaller than the one rotation frequency of the intermediate transfer member 7.

As a result, the image writing start position is shifted for each page in the sub-scan direction by an amount of (process speed×ts) [mm], thereby avoiding the overlapping of the images on the intermediate transfer member 7. Further, the shift amount of the writing start position is determined by the outer diameter of the intermediate transfer member 7, the process speed and the allowable sheet-to-sheet distance, and, in the illustrated embodiment, the writing start position can be changed up to 0.5 to 40 mm.

While controlling the print controller (not shown) by the control device (CPU) 14 so that the writing start position is shifted in the main scan and sub-scan directions, the above-mentioned evaluation was effected. It was ascertained that the negative ghost is not generated in the last solid pattern even after 499 same patterns were printed.

In this way, in the illustrated embodiment, in synchronous with the fact that the image writing start position on the intermediate transfer member 7 is shifted in the sub-scan direction of the laser beam, the supplying timing of the transfer material P is simultaneously shifted by the same time. As a result, since the next print pattern is not overlapped with the previous image pattern on the intermediate transfer member 7, the generation of the negative ghost can be suppressed. In this case, the relative position of the transfer material P regarding the intermediate transfer member 7 is not shifted.

Further, in the illustrated embodiment, since the entire intermediate transfer member 7 can be used efficiently (by utilizing the advantage of "seamless") when the mono-color print sequence is effected while controlling the shift amount of the image writing start position, the through-put can be improved.

Further, even when the vertical synchronous signal is not adjusted by effecting the change with respect to the writing start position signal (absolute reference on the intermediate transfer member 7), by shifting the toner image in the main scan direction for each page, the generation of the negative ghost can be suppressed when two toner images are formed on the peripheral surface of the intermediate transfer member 7 and the images are formed continuously in order to improve the through-put of the image formation.

Incidentally, in the illustrated embodiment, while an example that the time period from one RS1 to the next RS1 is smaller than the one rotation frequency of the intermediate transfer member 7 was explained, even when the time period becomes greater than the one rotation frequency, the same advantage can be achieved regarding accumulated negative ghost on the intermediate transfer member 7.

[Fourth Embodiment]

In a fourth embodiment of the present invention, the position of the intermediate transfer member 7 itself is shifted in the main scan direction between pages. A shift mechanism (not shown) for shifting the intermediate transfer member 7 is connected to the intermediate transfer member 7, and the shift mechanism is controlled by the control device (CPU) 14.

The intermediate transfer member 7 has a non-image area where the image is not formed. When the full-color image is formed, in the firstly-transferring process, a time period during which color toners reach the developing station on the photosensitive member 1 (effected by a rotary of the developing means) is given to the non-image area.

In the illustrated embodiment, between pages (after the tip end of the toner image on the intermediate transfer member 7 was secondary-transferred onto the transfer material and before the next toner image is firstly-transferred from the photosensitive member 1 to the intermediate transfer member 7), at the non-image area of the intermediate transfer member 7, the intermediate transfer member 7 is once separated from the photosensitive member 1 and then is shifted by 0.5 mm in the main scan direction, and, thereafter, the intermediate transfer member 7 is contacted with the photosensitive member 1 again. It is preferable that this process for shifting the intermediate transfer member 7 with respect to the photosensitive member 1 is effected after the tip end of the residual toner was charged and before the next toner image is firstly-transferred from the photosensitive member 1 to the intermediate transfer member 7. In this case, the photosensitive member 1 and the intermediate transfer member 7 are rotated at the same speed. In the secondary-transferring, since the relative position of the transfer material P with respect to the intermediate transfer member 7 is not substantially changed in the main scan direction, when the intermediate transfer member 7 is shifted in the main scan direction, image printing accuracy on the transfer material (paper sheet) P, particularly, left end registration is dispersed. Thus, since the intermediate transfer member cannot be shifted greatly, it is desirable that the shift amount of the intermediate transfer member is selected to about 0.5 mm.

By controlling the shift mechanism (not shown) by means of the control device (CPU) 14 so that, at the non-image area of the intermediate transfer member 7, the intermediate transfer member 7 is once separated from the photosensitive member 1 and then is shifted by 0.5 mm in the main scan direction, the above-mentioned evaluation was effected. It was ascertained that the negative ghost is not generated in the last solid pattern even after 499 same patterns were printed.

In this way, according to the illustrated embodiment, by shifting the position of the intermediate transfer member 7 itself in the main scan direction between pages, since the next print pattern is not overlapped with the previous image pattern on the intermediate transfer member 7, the generation of the negative ghost can be suppressed. The control of the engagement and disengagement between the intermediate transfer member and the photosensitive member as is in the fourth embodiment can be combined with the first to third embodiments.

What is claimed is:

1. An image forming apparatus comprising:

a movable image bearing member for bearing a toner image;

a movable intermediate transfer member to which the toner image on said image bearing member is electrostatically transferred at a first transfer position thereof;

a charge means for charging residual toner remaining on said intermediate transfer member, after the toner image on said intermediate transfer member was electrostatically transferred onto a transfer material at a second transfer position thereof, with polarity opposite to charging polarity of normal toner on said image bearing member, wherein an electric field is formed so that a transfer of the residual toner charged by said charge means from said intermediate transfer member onto said image bearing member and a transfer of a next toner image from said image bearing member onto said intermediate transfer member are simultaneously performed at said first transfer position; and a control means for controlling so that, when toner images are continuously transferred onto a plurality of transfer materials, a relative position of a first toner image transferred to a first transfer material from said intermediate transfer member with respect to said intermediate transfer member and a relative position of a second toner image transferred to a second transfer material from said intermediate transfer member with respect to said intermediate transfer member, are differentiated in a direction substantially perpendicular to a moving direction of said intermediate transfer member.

2. An image forming apparatus according to claim 1, wherein said control means controls so that the position of the first toner image with respect to said intermediate transfer member and the position of the second toner image with respect to said intermediate transfer member are differentiated in the moving direction of said intermediate transfer member.

3. An image forming apparatus according to claim 2, wherein said control means controls so that the position of the first toner image and the position of the second toner image with respect to said intermediate transfer member are differentiated in a moving direction of said image bearing member.

4. An image forming apparatus according to claim 1, wherein said control means controls so that the position of the first toner image and the position of the second toner image with respect to said intermediate transfer member are differentiated in a direction substantially perpendicular to the moving direction of said image bearing member.

5. An image forming apparatus according to claim 1, further comprising a second control means for controlling a relative position of said intermediate transfer member with respect to said image bearing member, wherein the relative position is changed in the direction substantially perpendicular to the moving direction of said intermediate transfer member, after a tip end of the first toner image on said intermediate transfer member was transferred to the transfer material and before the second toner image is transferred from said image bearing member to said intermediate transfer member.

6. An image forming apparatus according to claim 1, wherein the first and second toner images are formed on the basis of substantially the same image information.

7. An image forming apparatus according to claim 1, wherein said intermediate transfer member can bear or hold a plurality of toner images while said intermediate transfer member is moved by one revolution.

8. An image forming apparatus according to claim 1, wherein the transferring of the first toner image from said intermediate transfer member to the first transfer material and the transferring of the second toner image from said intermediate transfer member to the second transfer material are effected continuously.

9. An image forming apparatus according to claim 1, wherein said control means controls so that the positions of toner images continuously transferred onto a plurality of transfer materials are differentiated in the direction substantially perpendicular to the moving direction of said intermediate transfer member for every predetermined number of toner images corresponding to a length of the toner image in the moving direction of said intermediate transfer member.

10. An image forming apparatus according to claim 1, wherein said image bearing member can bear plural color toner images, and the plural color toner images on said image bearing member are successively transferred onto said intermediate transfer member in a superimposed fashion at said first transfer position, and the plural color toner images on said intermediate transfer member are transferred onto the transfer material at said second transfer position.

11. An image forming apparatus according to claim 10, wherein the electric field is formed so that the transfer of the residual toner charged by said charge means from said intermediate transfer member onto said image bearing member and the transfer of the next toner image from said image bearing member onto said intermediate transfer member are simultaneously performed at said first transfer position, after the plural color toner images on said intermediate transfer member are transferred onto the transfer material at said second transfer position.

12. An image forming apparatus according to claim 11, wherein first plural color toner images including the first toner image are transferred from said intermediate transfer member to the first transfer material, and second plural color toner images including the second toner image are transferred from said intermediate transfer member to the second transfer material.

13. An image forming apparatus according to claim 11, wherein the transferring of first plural color toner images including the first toner image from said intermediate transfer member to the first transfer material and the transferring of second plural color toner images including the second toner image from said intermediate transfer member to the second transfer material are effected continuously.

14. An image forming apparatus according to any one of claims 1 to 13, wherein a position of the transfer material with respect to said intermediate transfer member in the direction substantially perpendicular to the moving direction of said intermediate transfer member is not changed both when the first toner image is transferred from said intermediate transfer member to the transfer material and when the second toner image is transferred from said intermediate transfer member to the transfer material.

* * * * *

UNITED STATES PATENT AND TRADEMARK OFFICE

CERTIFICATE OF CORRECTION

PATENT NO. : 5,999,763

DATED : December 7, 1999

INVENTORS : Koichi Hiroshima, et al.

It is certified that error appears in the above-identified patent and that said Letters Patent is hereby corrected as shown below:

IN THE DRAWINGS:

Sheet 6, Figure 10, "FREQUENCE" should read --FREQUENCY--.

COLUMN 4

Line 27, "regist" should read --resist--.

COLUMN 6

Line 50, "5 μm" should read --20 μm--;
Line 56, "affects" should read --exerts--;
Line 59, "wisker" should read --whisker--; and
Line 61, "urethan" should read --urethane--.

COLUMN 9

Line 22, "fatness of about 5 dot line clearly becomes" should read --a width of about 5 dot line clearly become--.

COLUMN 11

Line 25, "in synchronous" should read --synchronously--;
Line 45, "previously" should read --previous--; and
Line 48, "image" should read --images--.

UNITED STATES PATENT AND TRADEMARK OFFICE

CERTIFICATE OF CORRECTION

PATENT NO. : 5,999,763

DATED : December 7, 1999

INVENTORS : Koichi Hiroshima, et al.

It is certified that error appears in the above-identified patent and that said Letters Patent is hereby corrected as shown below:

COLUMN 12

Line 16, "in synchronous" should read --synchronously--; and

Line 61, "rotary" should read --rotation--.

Signed and Sealed this

Nineteenth Day of December, 2000

*Attest:*

Q. TODD DICKINSON

*Attesting Officer*

*Commissioner of Patents and Trademarks*